US006434844B1

(12) United States Patent
Rank

(10) Patent No.: US 6,434,844 B1
(45) **Date of Patent: *Aug. 20, 2002**

(54) SEE-THRU ENGINEERING INSTRUMENT

(76) Inventor: David William Rank, 1427 Racine St., Menasha, WI (US) 54952

( * ) Notice: Subject to any disclaimer, the term of this patent is extended or adjusted under 35 U.S.C. 154(b) by 0 days.

This patent is subject to a terminal disclaimer.

(21) Appl. No.: 09/706,979

(22) Filed: Nov. 6, 2000

Related U.S. Application Data

(63) Continuation of application No. 09/058,447, filed on Apr. 10, 1998, now Pat. No. 6,158,135.

(51) Int. Cl.[7] ..... B43L 7/00

(52) U.S. Cl. ..... 33/494; 33/1 B; 33/563; 33/483; D10/64

(58) Field of Search ..... 33/493, 1 B, 1 C, 33/1 BB, 483, 494, 562, 563, 564, 565, 566, 403, 448; D10/64; 434/85, 87

(56) References Cited

U.S. PATENT DOCUMENTS

| | | | | |
|---|---|---|---|---|
| 192,135 | A | 6/1877 | Somes | |
| 304,245 | A | 8/1884 | Thomas | 33/483 |
| 846,006 | A | 3/1907 | Bryson | |
| 989,327 | A | 4/1911 | Brubaker | |
| 1,043,789 | A | 11/1912 | Whalen | 33/494 |
| 1,808,705 | A | 6/1931 | Owen, Jr. | |
| D137,459 | S | 3/1944 | Colmery | D10/71 |
| 2,364,529 | A | 12/1944 | Hill | |
| 2,799,938 | A | 7/1957 | Anderson | |
| D195,225 | S | 5/1963 | Traum | D10/71 |
| 3,419,962 | A | 1/1969 | Warner | |
| 4,462,168 | A | 7/1984 | Lynch et al. | 33/492 |
| 4,490,921 | A | 1/1985 | Woods et al. | 33/476 |
| 4,565,012 | A | 1/1986 | Bilodeau et al. | 33/458 |
| 4,779,346 | A | 10/1988 | Schafer | 33/1 B |
| D311,873 | S | 11/1990 | Arend | D10/71 |
| D374,404 | S | 10/1996 | Kidd | D10/71 |
| 6,158,135 | A * | 12/2000 | Rank | 33/494 |

OTHER PUBLICATIONS

Super Quickline Ruler by Nancy Crow Date before Sep. 1995.*

"Transparule Ruling Devices," Dec. 1946, 1 sheet(2–sided).

* cited by examiner

*Primary Examiner*—Christopher W. Fulton
(74) *Attorney, Agent, or Firm*—Wilhelm Law Service; Thomas D. Wilhelm; Jerry F. Janssen

(57) ABSTRACT

A see-thru engineering instrument has markings defining sets of longitudinal reference lines along its length. The reference lines are disposed inwardly of the side edges, and define segmentation patterns distinct to each set, distinguishing lines of the respective sets from each other. Lines of respective sets are preferably interposed each between respective lines of ones of another set or sets. Line segments in a single instrument, of the like illustrated, can define discrete measurable distances of any one, up to all, of 1/16, 1/8, 3/16, 1/4, 1/2, 3/4, 13/16, 7/8 and 15/16 inch. The back surface of the instrument preferably has a matte finish. The width of the instrument is greater than 3 inches, preferably about 4 inches. The length is greater than 12 inches, preferably about 13 inches. The thickness is preferably about 1/16 inch. The length/width ratio is at least 3/1. The markings on the instrument can include a grid of squares, marked over less than 2/3 of the overall area. The instrument can include at least 4 different scales. In some embodiments, at least one marking line extends at an angle of 45 degrees, or other angle, to one of the side edges. A protractor, having an origin associated with a side edge can be included. Generally, the markings are disposed closer to the back surface than to the front surface.

26 Claims, 3 Drawing Sheets

SEE-THRU ENGINEERING INSTRUMENT

CROSS-REFERENCE TO RELATED APPLICATIONS

This application is a Continuation of U.S. Pat. No. 6,158,135 which issued Dec. 12, 2000, from application Ser. No. 09/058,447 filed Apr. 10, 1998, the disclosure of which is incorporated herein by reference in its entirety.

BACKGROUND

Engineering drawings are widely used to ensure that articles are fabricated to known specifications. Thus, a draftsman makes a scale-drawing of an article to be manufactured. The drawing, when properly drafted, provides a suitable tool for communicating to manufacturing personnel the exact nature, and sometimes the standards to be used, in fabricating the article or articles represented by the drawing.

Manufacturing personnel use the drawing as the basis from which the article is manufactured. Thus, manufacturing personnel scale the drawing in order to ascertain general size, shape, angles radii, and is the like, which information is needed to create that particular something which is represented by the drawing.

Such drawings can be used to represent a wide variety of subjects including, without limitation, chemical structures, electrical circuits, industrial goods, transportation goods, construction projects such as roads, bridges, and buildings, and consumer goods and the like.

In view of the fact that such engineering drawings are used to ensure proper sizing, shape, materials, and the like, creating such drawings is an exacting task requiring a high level of skill, and suitable engineering tools.

Various tools and instruments, hereinafter collectively referred to as "instruments," are available to assist the draftsman in creating engineering drawings. For example, such tools and instruments as a T-square, a protractor, one or more scales, a ruler, and one or more triangles may be utilized in the completion of a single drawing.

Similarly, manufacturing and like personnel read and interpret such drawings in order to make, repair, or use, etc. the article or project represented by the drawing. Just as the draftsman must be precise in creating the drawing, so must the user be precise in interpreting the drawing. Accordingly, just as the draftsman uses a variety of tools and instruments in creating the drawing, so does the user also utilize a variety of tools and instruments in interpreting the drawing.

It is conventionally known for a given craftsperson to employ a plurality of tools and instruments, such as those described above, whether for creating a single drawing or for interpreting a single drawing. Namely, it is common to use a variety of tools and/or instruments in either the creation or the interpretation of any one drawing. Where several tools and/or instruments may be required for creating or interpreting a given drawing, the larger the number of tools and/or instruments desired to be used, the greater the probability that at least one of such tools and instruments will be misplaced, broken, be in use by another worker, or otherwise unavailable, whereby the work may be stopped or truncated, or the work may be done without use of one or more of the proper tools and instruments. If a needed tool or instrument is not available, and the work is done without the tool, e.g. in order to meet a deadline, those checks and balances are lost, which checks and balances generally accompany use of the proper tools, along with corresponding assurance of the quality of the work.

In view of the wide variety of tools and instruments typically used to create and/or interpret engineering drawings, it is desirable to provide a multi-function engineering instrument or tool, which can replace multiple conventional engineering instruments or tools.

The present invention provides an engineering instrument incorporating therein a plurality of drafting and interpreting capabilities, obviating the need for certain combinations of the conventionally available drafting and engineering tools, in addition to providing a number of function combinations never before available in a single engineering instrument.

Accordingly, it is an object of the present invention to provide a multifunctional see-thru engineering instrument useful in performing a variety of drafting, scaling, and other engineering tasks.

It is another object of the invention to provide a multifunctional see-thru engineering instrument which, by virtue of combined length and width of such instrument, can perform the functions of a T-square, thus eliminating the need to work off the edge of a drafting table or the like.

It is still another object of the invention to provide a see-thru engineering instrument wherein one or more lines in the body of the instrument can be used as reference lines for drawing parallel lines.

It is yet another object of the invention to provide, in such instrument, a protractor having an origin at an edge of such engineering instrument, and no open arc about the angle markings described by the protractor.

It is a further object of the invention to provide at least one reference line extending at an angle of 45 degrees to a side edge of such engineering instrument.

It is yet a further object of the invention to provide up to four scales in association with one or more edges of such engineering instrument wherein the measuring scales have a corresponding number of scale sizes, for making measurements on drawings drawn to respective such scale sizes.

Another object of the invention is to provide a see-thru engineering instrument having markings defining longitudinal reference lines disposed inwardly of the edges of the instrument.

SUMMARY OF THE DISCLOSURE

The invention generally comprises a see-thru engineering instrument, preferably a transparent engineering instrument. In a first family of embodiments, such see-thru engineering instrument has a length and a width, defining an overall area of the engineering instrument, first and second longitudinal side edges along the length of the engineering instrument, and third and fourth end edges along the width of the engineering instrument. The engineering instrument has markings, defining at least first and second longitudinal reference lines along the length of the instrument, the reference lines being disposed inwardly of the first and second side edges, the first reference line defining a segmentation pattern distinguishing the first reference line, as a distance measurement reference, from the second reference line, according to segmentation patterns of the two reference lines.

Preferred such engineering instruments have a front surface for disposition away from a work piece to be marked, and a back surface for disposition toward a work piece to be marked, the back surface having a matte finish. The markings on the instrument are preferably located closer to the back surface than to the front surface, and are most preferably located closely adjacent the back surface.

The width of preferred embodiments of the engineering instrument is greater than 3 inches, more preferably about 4 inches.

The length of preferred embodiments of the engineering instrument is greater than 12 inches, more preferably about 13 inches.

The thickness is preferably at least about 1/16 inch.

In a highly preferred embodiment, the length of the engineering instrument is 12.98 inches, the width is 3.98 inches.

In some embodiments, the markings include a grid of squares, marked over less than 50% of the overall area of the engineering instrument, the grid generally comprising lines defining square blocks 1/8 inch on each side.

Some embodiments include first, second, third and fourth different scales. Preferably, the four scales are a full size scale, a 1/2 size scale, a 1/4 size scale, and a 1/8 size scale.

The scales preferably include respective numbering sets corresponding to the respective scales, each scale being different from each other of the scales, the first and second scales being disposed in association with the first side edge, the third and fourth scales being disposed in association with the second longitudinal side edge. The scales can, however, be rearranged in a variety of patterns for association, respectively, of any of the scales with any of the edges of the instrument.

Some embodiments include yet another, or a substitute, scale which is a 1/16 size scale.

In some embodiments the markings include at least three transverse lines spaced like distances preferably no less than I centimeter apart, preferably 1 inch apart, and preferably spanning substantially the entire width of the engineering instrument.

Some of the preferred embodiments comprehend the first reference line being comprised in a first set of reference lines defining a first segmentation pattern, the second reference line being comprised in a second set of reference lines defining a second segmentation pattern, different from the first segmentation pattern.

In highly preferred embodiments, the first reference lines of the first set and the second reference lines of the second set are interposed each between respective ones of the other.

Preferably, the first reference lines are spaced a first common distance, e.g. 1/2 inch, apart and the second reference lines are spaced a second common distance, e.g. 1/2 inch, apart. A third set of longitudinally-extending reference lines defines third segmentation patterns different from the first and second segmentation patterns. The third reference lines are preferably spaced a third common distance, e.g. 1/4 inch, apart.

In preferred embodiments, respective ones of the second and third reference lines define line segments defining specific line lengths of less than 1 inch. The line segments may define discrete measurable line segment lengths of one or more of 1/8, 1/4, 1/2 and 3/4 inch. Preferably, the second line defines line segments having lengths of 1/8 inch and 3/4 inch.

Overall, the invention comprehends line segments in a single engineering instrument, defining discrete measurable distances of any one, up to all, of 1/16, 1/8, 3/16, 1/4, 1/2, 3/4, 13/16, 7/8 and 15/16 inch, including all length dimensions and combinations in between.

In some embodiments, the engineering instrument has a column of at least three number characters disposed along the width of the engineering instrument and indicating dimensions along the width of the engineering instrument, the characters preferably being spaced at equidistant intervals representing distances of e.g. one inch, though a wide variety of other spacing intervals is contemplated.

Some embodiments contemplate transverse lines, spaced e.g. 1 inch apart, extending across the width of the engineering instrument at right angles to the first side edge, whereby the transverse lines cross the first reference lines at respective e.g. one-inch intervals. Namely, the first reference line can comprise an uninterrupted, though crossed, single line segment extending substantially the full length of the engineering instrument without substantial break in such line.

Preferably, the second reference lines comprise longitudinally-spaced line segments of alternating relatively longer lengths and relatively shorter lengths, and the third reference lines comprise longitudinally-spaced line segments of equal length.

In some embodiments, the markings include at least one marking line extending at an angle of 45 degrees to e.g. one of the longitudinal side edges.

The markings may define a protractor on the engineering instrument, the protractor having an origin associated with e.g. one of the first and second longitudinal side edges.

In preferred embodiments, the markings are disposed closer to the back surface than to the front surface of the instrument.

In a second family of embodiments, a see-thru engineering instrument comprises markings defining a first measuring scale associated with the first side edge, a protractor having an origin associated with one of the first and second side edges, and a grid comprising lines defining squares associated with one of the side and end edges, the grid extending inwardly away from the respective edge, and covering no more than 2/3, preferably no more than 1/2, of the overall area of the engineering instrument. Preferred members of such family embody all the above mentioned combinations of instrument structures and functions.

In a third family of embodiments, such see-thru engineering instrument comprises markings defining a first measuring scale associated with the first side edge; and a second measuring scale, at least three inches long and extending along one of the end edges, wherein the engineering instrument has a length/width ratio of at least 2/1.

Figure 1:
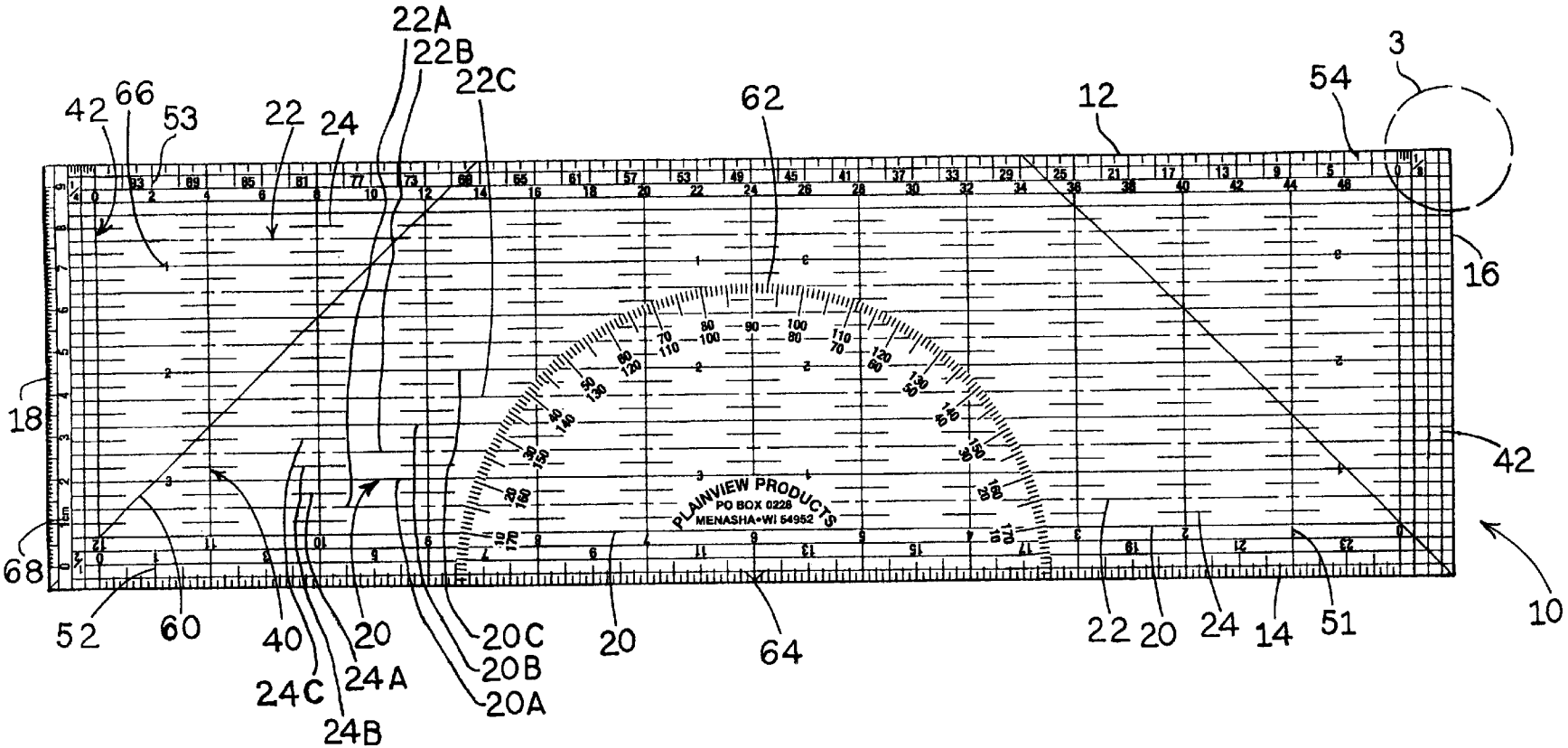
FIG. 1 is a plan view of a first representative embodiment of a see-thru engineering instrument of the invention.

The invention is not limited in its application to the details of construction and the arrangement of the components set forth in the following description or illustrated in the drawings. The invention is capable of other embodiments or of being practiced or carried out in various ways. Also, it is to be understood that the terminology and phraseology employed herein is for purpose of description and illustration and should not be regarded as limiting. Like reference numerals are used to indicate like components in the several drawings.

DETAILED DESCRIPTION OF THE ILLUSTRATED EMBODIMENTS

Referring now to FIG. 1, engineering instrument 10 is made from a see-thru material such as a transparent plastic.

It is critical to proper performance of instrument 10 that the grid marks imparted to the instrument be visible to the user. It is also critical that, when instrument 10 is placed on a work piece (e.g. sheet of paper), the underlying work piece, and any drawing (e.g. lines) made or partially made, be visible through the instrument. Accordingly, the material from which instrument is fabricated is critical to proper functioning of the instrument.

The material is preferably transparent. Certain lightly translucent materials, namely materials having modest degrees of cloudiness or other visual impediment, are acceptable so long as lines and indicia on the underlying work piece can be accurately observed and interpreted through the instrument. Accordingly, any material which provides a suitable degree of light transmission that permits of proper reading and interpreting of the information on the underlying work piece, is acceptable.

Examples of suitable materials are various types of transparent, preferably colorless, plastic sheet material. However, colored materials are acceptable if such sheet materials have sufficient see-thru properties to enable accurate reading and interpretation of an underlying drawing. Such flexible plastic sheet material should be sufficiently thick to withstand normal engineering use, yet sufficiently light to be easily manipulated while creating or interpreting a drawing. The material selected must be strong enough to tolerate normal engineering use, yet flexible and resilient for efficient manipulation. Examples of preferred materials are polycarbonate, acrylic, and like plastics having suitable strength.

A preferred thickness is about 1/16 inch. Thicker materials may be used, up to about 1/8 inch or more, but thicker materials are heavier and more clumsy to use. Thinner material can be used, down to about 1/32 inch. While materials modestly thinner than 1/16 inch are easier to use, such materials are not as durable, and so are not preferred.

Referring now to FIG. 1, first and second longitudinal side edges 12 and 14 extend along the length of the instrument, and third and fourth end edges 16 and 18 extend along the width of instrument 10.

In the embodiment illustrated, instrument 10 has a length greater than 12 inches, a width of at least 3 inches, and thickness of preferably about 1/16 inch. In preferred embodiments, the length is about 13 inches and the width is about 4 inches.

More preferably, the length and width of the engineering instrument are each shortened about 0.02 inch from the nominal length and width, namely about the width of a draftsman's typical pencil line, thus making the length of the engineering instrument 12.98 inches and the width 3.98 inches.

The markings on instrument 10 are positioned such that dimension lines extending parallel to a respective edge are spaced from the respective edge a distance to provide construction of a line at the edge while holding the respective reference line over a reference mark on the underlying work piece, and wherein the line so constructed is precisely the dimension indicated for the reference line on the instrument.

Stated another way, reference lines on the instrument are spaced from each other by respective common distances such as 1/8 inch, 1/4 inch, 1/2 inch, and the like, while the line most closely paralleling an edge is spaced from the respective edge by a distance equal to such common dimension less a 0.02 inch allowance for the width of the pencil mark to be made at the edge of the instrument. As used herein, all such dimensions allow for, but do not require, such 0.02 inch adjustment at the edge of the instrument.

Reference line 20 is one of a first set of reference lines 20A, 20B, 20C, and the like spaced across the width of instrument 10, each line extending along the length of the instrument. The lines 20 define a first segmentation pattern of namely unbroken lines each defined by a single line segment extending the full length of the instrument 10.

Second reference line 22 is one of a second set of reference lines 22A, 22B, 22C, and the like spaced across the width of instrument 10, each line extending along the length of the instrument. The lines 22 define a second segmentation pattern, further described hereinafter, different from the first segmentation pattern.

Third reference line 24 is one of a third set of reference lines 24A, 24B, 24C, and the like spaced across the width of instrument 10, each line extending along the length of the instrument.

Longitudinal reference lines 20, 22, and 24 are disposed inwardly of first and second side edges 12, 14. First longitudinal reference line 20 is a solid unbroken line defining a single line segment extending the full length of instrument 10, whereby the segmentation pattern is represented by the single, unbroken, segment.

As seen in FIG. 1, lines 20A, 20B, 20C, of the first set are interposed between respective lines 22A, 22B, 22C, of the second set; and a reference line 24 is interposed between each pair of lines 20, 22.

In the first set of reference lines 20, each reference line is unbroken and continuous along the full length of instrument 10. Thus, each line comprises a single line segment, from end to end of the instrument.

By contrast, each line 22 comprises a series of aligned, sequentially alternating long line and short line segments separated by spaces between the respective line segments. Each long segment in the illustrated embodiment is 3/4 inch long. Each short segment is 1/8 inch long. The spaces between the long segments and the short segments are 1/16 inch long. Accordingly, the segmentation pattern of the second set of reference lines 22 is different from the segmentation pattern of the first set of reference lines 20. By combining the lengths of the long and short segments, and the known spacings between the segments, one can use the segmentation of a second reference line to measure the lengths of 1/16, 1/8, 3/16, 1/4, 3/4, 13/16, 15/16, and 1 inch. The dimensions in the drawings are, of course, not to scale, although the relationships are generally representative.

Each line 24 comprises a series of alternating line segments and spaces, all line segments, and spaces between line segments, being of equal length, namely 1/2 inch in the illustrated embodiment. A wide variety of other lengths are contemplated.

Accordingly, the set of lines 20 represent a first separate and distinct segmentation pattern different from the segmentation pattern of either set of lines 22 or 24; and lines 22 and 24 represent second and third separate and distinct segmentation patterns different from each other.

Preferably first reference lines 20 are spaced a first common distance such as 1/2 inch from each other across the width of instrument 10; second reference lines 22 are spaced a second common distance such as 1/2 inch from each other across the width of instrument 10; and third reference lines 24 are spaced a third common distance such as 1/4 inch from each other across the width of the instrument.

The line segments, as illustrated, define discrete measurable distances. For example, the line segments may define discrete measurable distances of 1/16, 1/8, 3/16, 1/4, 1/2, 3/4, 13/16, 7/8 and 15/16 inch, whether along a printed line segment, along a space between adjacent line segments, or a combination of spaces and printed line segments.

While three segmentation patterns are illustrated by reference lines 20, 22, and 24, a wide variety of other segmentation patterns, and reference line arrangements, will now be obvious to those skilled in the art; and all such obvious patterns and line arrangements are contemplated to be within the scope of the invention described and claimed herein.

The markings on transparent engineering instrument 10 include at least one, preferably at least 3, transverse lines 40 extending across the width of engineering instrument 10 at right angles to side edge 12 and/or 14, thereby crossing first reference lines 20 at e.g. 1 inch intervals. FIG. 1 illustrates such lines 40 traversing the instrument at 1 inch intervals and spaced along the entire length of the instrument.

Figure 3:
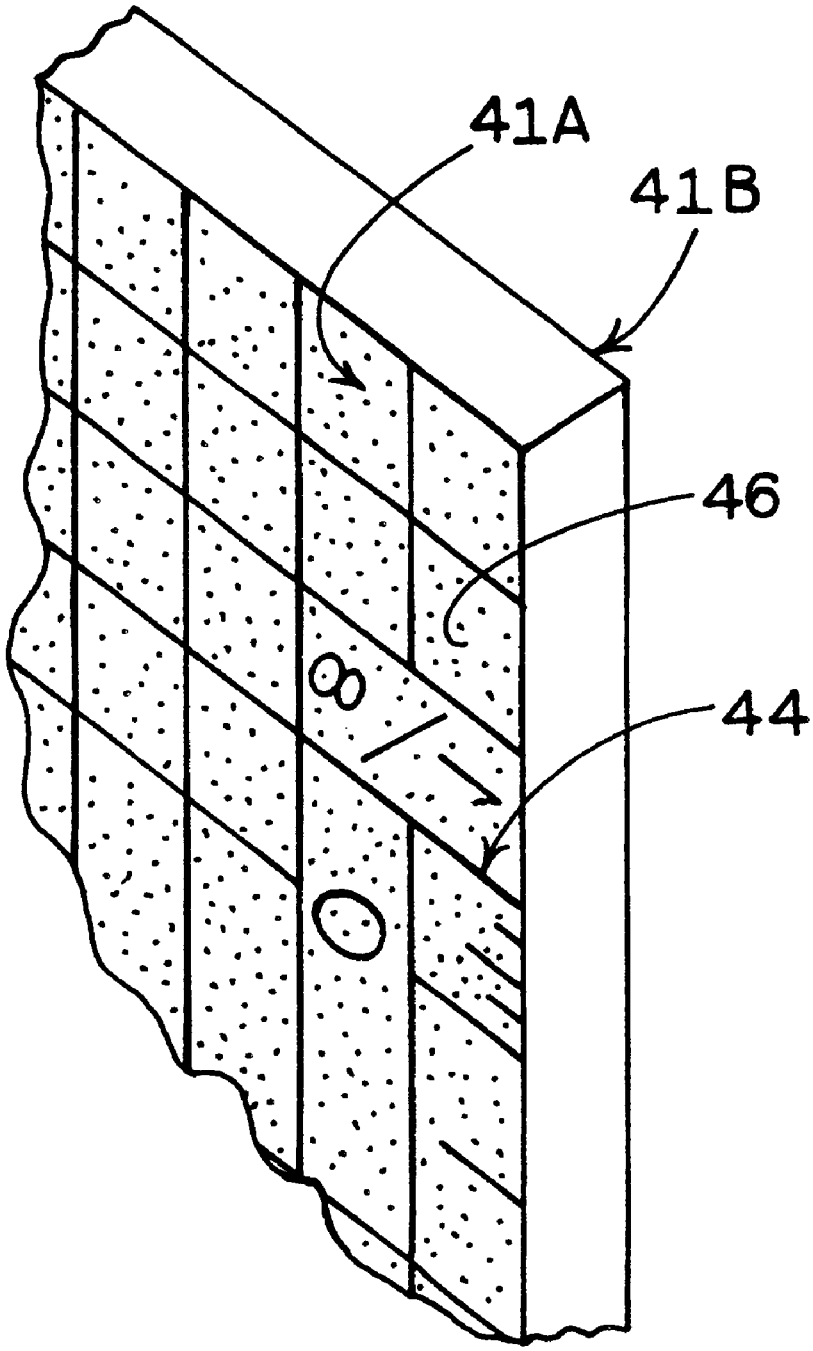
FIG. 3 is an enlarged pictorial view, looking toward the back surface of the engineering instrument, and is taken at circle "3" in FIG. 1.

Instrument 10 further includes back and front surfaces 41A, 41B respectively. See FIG. 3. The markings 44 on engineering instrument 10 are disposed closer to the back surface than to the front surface.

In fabricating instrument 10, markings 44 are printed (e.g. screen printed), engraved, or otherwise fabricated on the back side of a suitable plastic work piece. After the markings have been printed, a matte finish coating 46 of a suitable see-thru material is applied over the markings. Such coatings, and methods of creating a matte finish therewith using e.g. conventional screen printing technology, are well known, and thus are not further discussed here.

The matte finish coating provides desirable properties to the instrument. First, the matte finish coating physically protects the markings. Second, the matte finish coating disrupts and reduces glare from the back surface of the instrument. Third, the matte finish coating prevents the instrument from sticking, as by surface friction, to an underlying (e.g. paper) work piece, and accordingly facilitates sliding movement of the instrument over such work piece.

Methods other than screen printing can be used for applying a matte finish to the work piece. For example, a plastic film can be fabricated having the desired matte surface texture, and such film applied (e.g. adhered) to the back surface of the plastic work piece with the matte surface disposed outwardly in the work piece.

Thus, in preferred embodiments, the full grid of markings 44 illustrated on instrument 10 is e.g. printed or otherwise placed on a surface of the plastic work piece that is to be disposed. at or closely adjacent back surface 41A of the instrument. With the markings so disposed closely adjacent the back surface, the usual parallax error, associated with ruler markings printed on top of the ruler, are avoided. Namely, if the markings were printed on or adjacent the top surface of the instrument, or even buried generally at the mid-point of the thickness, both as in conventional engineering instruments, any deviation of the user from a position vertically over the instrument when viewing an underlying drawing, results in a parallax error. By contrast, with the markings closely adjacent the back surface, the markings are also closely adjacent the work piece (paper), whereby parallax is substantially eliminated regardless of the position of the user with respect to a vertical orientation over the work piece.

The markings of engineering instrument 10 further comprises two grids of squares 42, adjacent respective end edges 16, 18, which grids of squares extend over substantially less than 50% of the overall area of instrument 10. FIG. 1, represents grids having lines defining square blocks nominally 1/8 inch long on each side of each square. The invention also comprehends grids of squares of other dimensions, such as a 1/16 inch grid and a 1/4 inch grid, either alone, or in combination on a single instrument.

First and second concurrently viewable scales 51, 52 are located adjacent side edge 14 and are arranged coextensively as illustrated in FIG. 1. Third and fourth concurrently viewable scales 53, 54 are located adjacent side edge 12 and are arranged coextensively as illustrated in FIG. 1.

Referring to FIG. 1, the first scale 51 represents a full size scale. Namely, either a full inch, or a full foot, is represented by 1 inch on the scale.

Scale 52 represents a 1/2 size scale wherein either a full inch or a full foot is represented by 1/2 inch on the scale.

Scale 53, adjacent side edge 12, represents a 1/4 size scale wherein either a full inch or a full foot is represented by 1/4 inch on the scale.

Scale 54, also adjacent side edge 12, represents a 1/8 size scale wherein either a full inch or a full foot is represented by 1/8 inch on the scale. Other embodiments could include a 1/16 and 1/32 size scales as well as corresponding full and fractional metric scales, or other scales as desired.

In each of the above scales 51–54, the respective scale is denominated in the actual dimension to be attributed to the work piece being read. Accordingly, the numbers read on the instrument represent the dimensions on the article or other structure represented by the underlying drawing. For example, and as illustrated in FIG. 1, a 12 inch run of the 1/8 scale is indicated, wherein the number 93 toward the high end of the 1/8 scale represents 93 units of measure on the article represented by the underlying drawing, assuming the underlying drawing indicates a 1/8 scale.

FIG. 1 illustrates a pair of lines 60 extending at angles of 45 degrees to side edges 12 and 14 and intersecting both of the side edges away from the midpoint of the length of instrument 10, whereby instrument 10 can be used to create lines at 45 degree angles from a base line. When a 45 degree angle line 60 is placed over the base line, a line disposed at 45 degrees to the base line can be drawn at edge 12 or 14. Lines corresponding to other angles such as 30 degrees or 60 degrees may also be used on instrument 10, either in addition to or in place of the 45 degree lines.

FIG. 1 shows protractor 62 having a baseline along side edge 14. Origin 64 of protractor is also associated with side edge 14. As illustrated in FIG. 1, instrument 10 is devoid of open arc about the angular markings of the protractor and spaced from the origin. In use, the line from which an angle is to be scribed is lined up through the origin and the angle desired for the new line. The desired line can then be drawn at the desired angle along side edge 14.

The characters "1," "2," "3," indicated at 66 illustrate a column of markings disposed along the width of the instrument and representing dimensions in inches (1, 2, 3 inches etc.) between the respective reference lines 20A, 20C, and the like. The characters 66 in the column are spaced at equal intervals from each other, representing distances of one inch. Such dimensions can be designed to represent any incremental measurement desired, along the width of the instrument.

In the preferred embodiment illustrated in FIG. 1, instrument is about 4 inches wide, which is sufficiently wide to provide for measurements of distances using the end edge of the instrument. Referring to FIG. 1, metric scale 68 is disposed along end edge 18. Thus, the user can measure distances using scale 68 on the end edge.

While instrument 10 has been illustrated in FIG. 1 with English measure along the side edge, and metric measure along the end edge, any units of measure can be marked on any edge. For example, the marking along the side edge could be metric while the marking along the end edge is English. Both side and end edges could be English. Both side and end edges could be metric. Thus, while specific units have been illustrated, any known units of measure of length can be substituted for those shown.

Figure 2:
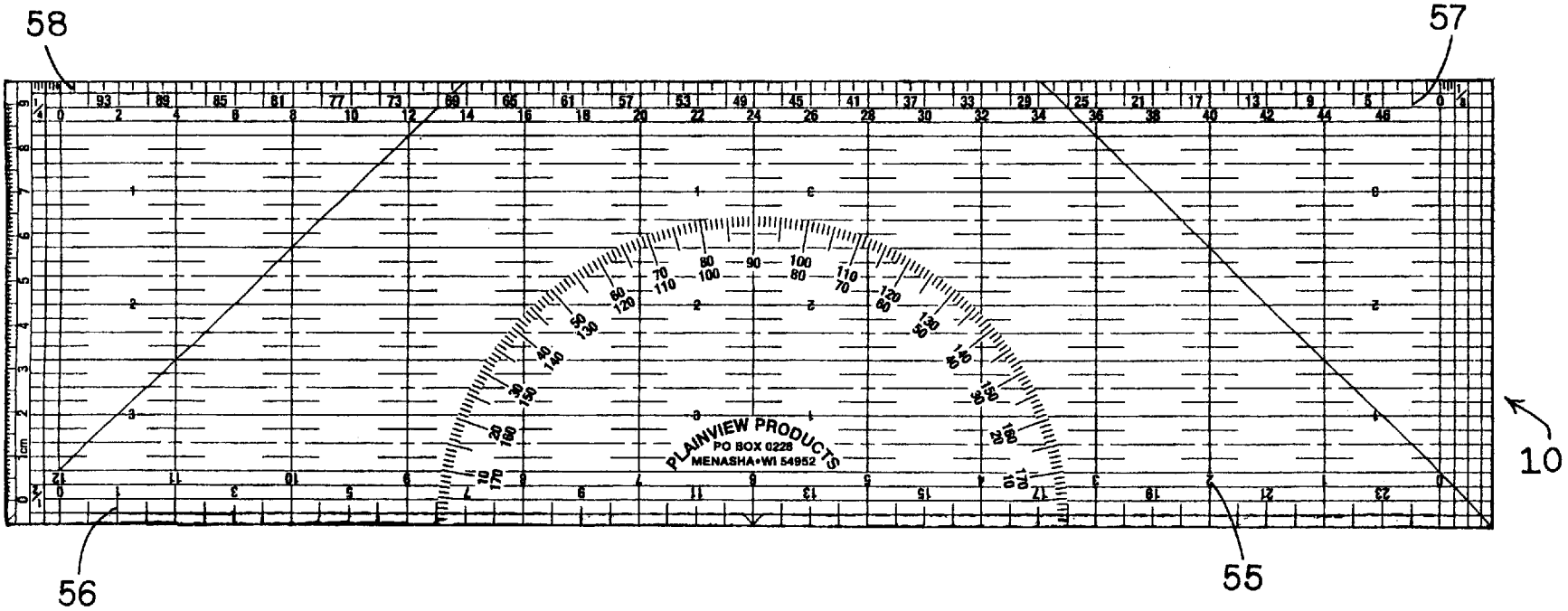
FIG. 2 is a plan view of a see-thru engineering instrument, of the invention, having metric scales.

FIG. 2 represents yet another embodiment of the invention wherein the scales are represented in the metric system. First scale 55 comprises single increments representing 2 cm. Second scale 56 comprises increments of 1 cm. Third scale 57 comprises increments representing 0.5 cm. Fourth scale 58 comprises increments representing 0.25 cm. The scale configuration of FIG. 2 is merely exemplary of one embodiment of scales in the metric system.

By "markings," we mean the full complement of measurement and drafting capabilities with which instrument is equipped by virtue of the lines and line segments, and scales and other characters imposed thereon. Thus, "markings" includes, without limitation, the several scales, the inch and metric indications at the edges of the instrument, the square grid, the protractor, the 45 degree lines, and the reference lines 20, 22, 24.

As used herein "matte" finish refers to any surface sufficiently rough to inhibit overall surface-to-surface frictional bonding of the back surface of the instrument to the underlying work piece such as a piece of paper. Accordingly, a matte finish is comprised of the combination of properties attributable to (a) material selected and (b) the physical characteristics of the surface created by the fabrication process.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A see-thru engineering instrument having first and second longitudinal side edges defining a length of said engineering instrument, and third and fourth end edges defining a width of said engineering instrument, the length and width, in combination, defining an overall area of said engineering instrument, said engineering instrument comprising markings defining at least one reference line extending at an angle of 45 degrees to one of the longitudinal side edges and intersecting both of the side edges away from the midpoint of the length of said engineering instrument, said markings defining at least first and second longitudinal reference lines, extending along the length of said engineering instrument, said longitudinal reference lines being disposed inwardly of said first and second side edges, said first reference line being comprised in a first set of reference lines defining a first segmentation pattern interrupting the respective line markings and thereby defining discrete measurable longitudinal distances, said second reference line being comprised in a second set of reference lines defining second discrete measurable longitudinal distances different from the first discrete measurable distances of the first line.

2. A see-thru engineering instrument as in claim 1, said engineering instrument further defining first, second, third, and fourth concurrently viewable different measuring scales, said first and second scales being arranged coextensively along said first longitudinal side edge, and said third and fourth scales being arranged coextensively along said second longitudinal side edge, each of said scales originating away from a mid-point of the length of said engineering instrument, and extending in ascending measurement toward one of the third and fourth end edges.

3. A see-thru engineering instrument as in claim 2, at least one of said first scale, said second scale, said third scale and said fourth scale being a ½ size scale.

4. A see-thru engineering instrument as in claim 2, at least one of said first scale, said second scale, said third scale and said fourth scale being a ¼ size scale.

5. A see-thru engineering instrument as in claim 2, at least one of said first scale, said second scale, said third scale and said fourth scale being a ⅛ size scale.

6. A see-thru engineering instrument as in claim 1, said first reference lines of said first set and said second reference lines of said second set being interposed each between respective ones of the other, segmentation of said first set of reference lines being different from segmentation of said second set of reference lines.

7. A see-thru engineering instrument as in claim 1 wherein said first reference lines are spaced a first common distance apart and said second reference lines are spaced a second common distance apart.

8. A see-thru engineering instrument as in claim 1 said first and second reference lines having line segments defining specific line segment lengths of less than 1 inch.

9. A see-thru engineering instrument as in claim 8 wherein spaced said line segments define discrete measurable line lengths measuring at least one of ⅛, ½, and ¾ inch along the length of said instrument.

10. A see-thru engineering instrument as in claim 8 wherein said line segments define discrete measurable distances of all of 1/16, ⅛, 3/16, ¼, ½, ¾, 13/16, ⅞ and 15/16 inch.

11. A see-thru engineering instrument as in claim 1, said markings defining a protractor on said engineering instrument, said protractor having an origin associated with one of said first and second longitudinal side edges.

12. A see-thru engineering instrument as in claim 1, said engineering instrument comprising further markings defining a measuring scale at least three inches long and extending along the third end edge.

13. A see-thru engineering instrument as in claim 1, including a metric scale extending along one of the third and fourth end edges.

14. A see-thru engineering instrument having first and second longitudinal side edges defining a length of said engineering instrument, and third and fourth end edges defining a width of said engineering instrument, the length and width, in combination, defining an overall area of said engineering instrument, said engineering instrument comprising markings defining at least one reference line extending at an angle of 45 degrees to one of the longitudinal side edges and intersecting both of the side edges away from the mid-point of the length of said engineering instrument, said markings further comprising first, second, third, and fourth concurrently viewable different measuring scales, said first and second scales being arranged coextensively along said first longitudinal side edge, and said third and fourth scales being arranged coextensively along said second longitudinal side edge, said markings defining at least first and second longitudinal reference lines along the length of said engineering instrument, said reference lines being disposed inwardly of the first and second side edges, said first line defining a segmentation pattern distinguishing said first reference line, as a distance measurement reference, from said second reference line, said first reference line being comprised in a first set of reference lines defining a first segmentation pattern, said second reference line being comprised in a second set of reference lines defining a second segmentation pattern different from- the first segmentation pattern.

15. A see-thru engineering instrument as in claim 14, the segmentation pattern of said second reference lines defining longitudinally-spaced line segments of alternating relatively longer lengths and relatively shorter lengths.

16. A see-thru engineering instrument as in claim 14, said first and second scales including first and second numbering sets corresponding to the respective first and second scales and differing from each other, said first and second scales being disposed in association with the first longitudinal side edge, said third and fourth scales including third and fourth numbering sets corresponding to the respective third and fourth scales, the third and fourth scales being different from each other and from the first and second scales, and being disposed in association with the second longitudinal side edge.

17. A see-thru engineering instrument having first and second longitudinal side edges defining a length of said engineering instrument, and third and fourth end edges defining a width of said engineering instrument, the length and width, in combination, defining an overall area of said engineering instrument, said engineering instrument comprising markings defining at least one reference line extending at an angle of 45 degrees to one of the longitudinal side edges and intersecting both of the side edges away from the midpoint of the length of said engineering instrument, said markings further comprising at least first longitudinal reference lines spaced inwardly from the first and second longitudinal side edges and extending along the length of said engineering instrument, and defining a first segmentation pattern defining first discrete measurable longitudinal distances, at least a given one of the first longitudinal reference lines comprising longitudinally-spaced line segments of relatively longer lengths and relatively shorter lengths.

18. A see-thru engineering instrument as in claim 17, said markings defining at least first and second longitudinal reference lines, extending along the length of said engineering instrument, said longitudinal reference lines being disposed inwardly of said first and second side edges, said first reference line being comprised in a first set of reference lines defining a first segmentation pattern interrupting the respective line markings and thereby defining discrete measurable longitudinal distances, said second reference line being comprised in a second set of reference lines defining second discrete measurable longitudinal distances different from the first discrete measurable distances of the first line.

19. A see-thru engineering instrument as in claim 18, said first reference lines of said first set and said second reference lines of said second set being interposed each between respective ones of the other, segmentation of said first set of reference lines being different from segmentation of said second set of reference lines.

20. A see-thru engineering instrument as in claim 19, said first and second reference lines having line segments defining specific line segment lengths of less than 1 inch.

21. A see-thru engineering instrument as in claim 20 wherein spaced said line segments define discrete measurable line lengths measuring at least one of 1/8, 1/2, and 1/4 inch along the length of said instrument.

22. A see-thru engineering instrument as in claim 20 wherein said line segments define discrete measurable distances of all of 1/16, 1/8, 3/16, 1/4, 1/2, 3/4, 13/16, 7/8 and 15/16 inch.

23. A see-thru engineering instrument as in claim 18 wherein said first reference lines are spaced a first common distance apart and said second reference lines are spaced a second common distance apart.

24. A see-thru engineering instrument as in claim 17, said markings further comprising first, second, third, and fourth concurrently viewable different measuring scales, said first and second scales being arranged coextensively along said first longitudinal side edge, and said third and fourth scales being arranged coextensively along said second longitudinal side edge, said markings defining at least first and second longitudinal reference lines along the length of said engineering instrument, said reference lines being disposed inwardly of the first and second side edges, said first line defining a segmentation pattern distinguishing said first reference line, as a distance measurement reference, from said second reference line, said first reference line being comprised in a first set of reference lines defining a first segmentation pattern, said second reference line being comprised in a second set of reference lines defining a second segmentation pattern different from the first segmentation pattern.

25. A see-thru engineering instrument as in claim 24, the segmentation pattern of said second reference lines defining longitudinally-spaced line segments of alternating relatively longer lengths and relatively shorter lengths.

26. A see-thru engineering instrument as in claim 24, said first and second scales including first and second numbering sets corresponding to the respective first and second scales and differing from each other, said first and second scales being disposed in association with the first longitudinal side edge, said third and fourth scales including third and fourth numbering sets corresponding to the respective third and fourth scales, the third and fourth scales being different from each other and from the first and second scales, and being disposed in association with the second longitudinal side edge.

* * * * *